United States Patent [19]

Amiaut

[11] 4,394,967

[45] Jul. 26, 1983

[54] GUN FOR APPLYING PAINTS BY HOT PROCESS

[76] Inventor: Jean Amiaut, 1 Rue des Cluzeaux, F-93240 Stains, France

[21] Appl. No.: 293,641

[22] PCT Filed: Dec. 18, 1980

[86] PCT No.: PCT/FR80/00184

§ 371 Date: Aug. 12, 1981

§ 102(e) Date: Aug. 12, 1981

[87] PCT Pub. No.: WO81/01670

PCT Pub. Date: Jun. 25, 1981

[30] Foreign Application Priority Data

Dec. 18, 1979 [FR] France ..... 79 30910
Oct. 31, 1980 [FR] France ..... 80 23293

[51] Int. Cl.[3] ..... B05B 1/24
[52] U.S. Cl. ..... 239/133; 239/397
[58] Field of Search ..... 239/133, 135, 139, 296, 239/587; 219/302, 303, 304, 305, 380

[56] References Cited

U.S. PATENT DOCUMENTS 2,976,392 3/1961 Wabnitz ..... 219/380
3,219,274 11/1965 Roche ..... 239/139

*Primary Examiner*—John J. Love
*Assistant Examiner*—Jon M. Rastello
*Attorney, Agent, or Firm*—Sughrue, Mion, Zinn, Macpeak and Seas

[57] ABSTRACT

The gun comprises a body having a downwardly extending grip (2) and an assembly comprising a heating block (4) having a vertical axis, a first envelope (5) defining with the block a sinuous path for heating air, and a second envelope (6) defining a path for paint. The second envelope (6) is in the shape of a bell and is pivotally mounted on top of and around the first envelope (5). The first envelope (5) and second envelope (6) define therebetween a chamber (45) which communicates with the paint path and has an outlet conduit (46) which extends through the heating block (4) and communicates with a rotary spraying head (T) mounted on the front end of the body (1). A vertical hot air passageway (28) coaxially surround the outlet conduit (46) and communicates with the sinuous path for heating air and also communicates with the spraying head. The second envelope (6) has a lateral boss (39) defining a passage which communicates with the path for the paint. The pivotable mounting of the second envelope (6) on the first envelope (5) enabales the passage (40) to be placed in a convenient position. The passage (40) is connectible either with a container of paint located above the body or with a pipe leading to a supply of paint located below the body. The passage (40) can be placed in close proximity to a vertical axis in vertical alignment with the grip (2).

7 Claims, 7 Drawing Figures

GUN FOR APPLYING PAINTS BY HOT PROCESS

DESCRIPTION

The present invention generally relates to paint guns and more particularly relates to a gun for the hot application of paints. It is known that the hot application of paints by means of a gun has very many and very important advantages over the conventional cold application of paints by means of a gun.

Different types of devices are known which are adaptable on guns for the hot application of paints which comprise heating means, usually electric heating resistances adapted to heat the paint and the spraying air for the latter.

There is described in French patent No. 79 05318 in the name of the Applicant a gun for the hot application of paints comprising a heating block containing electric resistances and enclosed in an envelope in which circulates the air for spraying the paint, this envelope being itself enclosed in the pot containing the paint which is adapted to be supplied directly to the gun by the effect of gravity.

This device is not completely satisfactory owing to the fact that it has a tendency to heat the whole of the paint contained in the pot. Consequently, the paint takes a very long time to heat up and its temperature is not uniform.

As the conventional guns are of metal which is a good conductor of heat, the grip of the gun very rapidly heats up and this renders its handling difficult for the operator. Further, in order to remove the spray head of conventional guns, a tool must be employed for unscrewing the screwthreaded ring which immobilises the nozzle the flanges of which comprise the air jets. Metal guns easily withstand the sometimes considerable forces which may be applied by means of this tool and which could not be supported by a gun made from a more fragile heat insulating material.

An object of the invention is to overcome these drawbacks and to provide a gun for the hot spraying of paints comprising an incorporated heating device made from a material which is a poor conductor of heat the air nozzle of which may be adjusted angularly without use of a tool and in which the volume of the heated paint is reduced to the minimum required amount.

Another object of the invention is to provide a gun for the hot spraying of modern paints which is antideflagrating and thus presents all the guaranties of safety.

The invention consequently provides a gun for the hot application of paints of the type comprising an assembly fixed to the body of the gun comprising a heating block including electric resistances disposed in a housing in which the spraying air circulates in contact with said block, said housing being in contact with the paint, characterised in that the gun comprises a first sinuous path for the air formed partly within said heating block and partly between said block and the inner surface of a first envelope, and a second sinuous path for the pain defined between the outer surface of said first envelope and a second envelope, said assembly being fixed to a gun body of insulating material having a rotary spraying head including two pairs of air jets at least one of which pairs is adjustable and in that it comprises automatic temperature regulating means controlled by the spraying air.

According to another feature of the invention, said first sinuous path for the air and said second sinuous path for the paint each comprise an outlet part extending through said heating block.

Preferably, said outlet parts are adjacent.

In a preferred embodiment, said outlet parts are concentric.

According to another feature of the invention, the total volume of the path for the paint and the total volume of the path for the spraying air are each adapted to permit, within a given period of time, flows of paint and air which respectively slightly exceed the flows of the paint and air of the gun in operation.

It will be understood that owing to this arrangement, the device according to the invention only heats at each instant the volumes of paint and air which are just a little greater than those supplied within the same period of time by the spraying head.

According to yet another feature of the invention, the first envelope carries on its outer surface projecting means which define with said second envelope the sinuous path for the paint, from a point located close to the base of said block to a chamber formed at its opposite end, said chamber being connected to the nozzle of the gun by way of an outlet conduit which extends through said heating block parallel to and adjacent to the outlet conduit of the first sinuous path for the paint.

Preferably, said outlet conduit for the air surrounds the outlet conduit of the second sinuous path for the paint.

The invention will be described hereinafter in more detail with reference to the drawings which show solely one embodiment, in which:

FIG. 1 shows a part of the gun according to the invention in section in a vertical plane containing the valve member of the paint ejecting nozzle.

Figure 1:
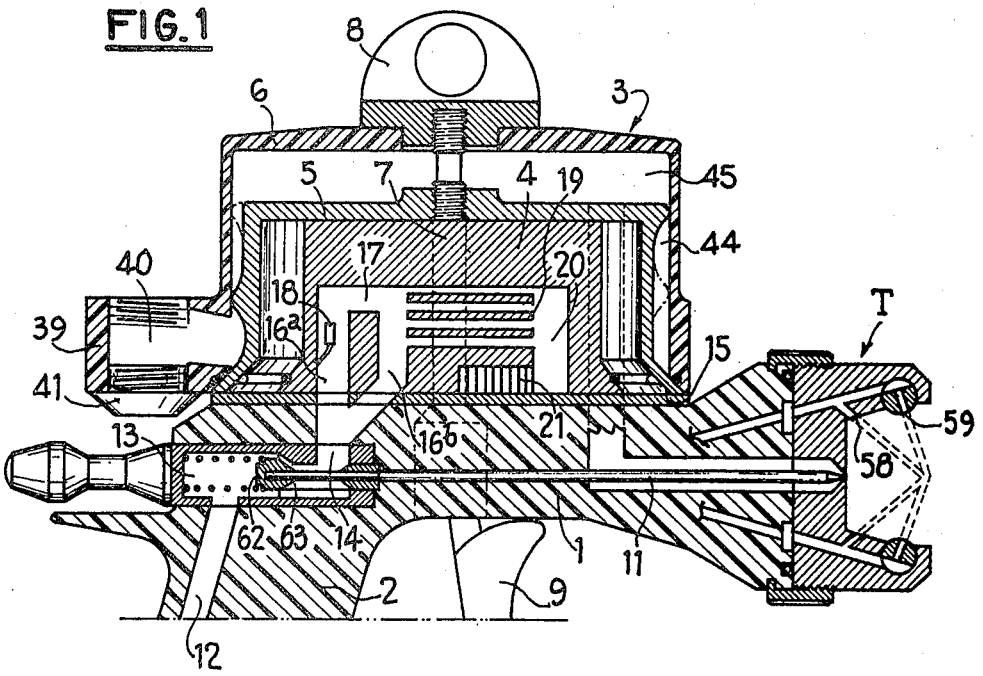
FIG. 1 is a partial sectional view of a gun according to the invention for the hot spraying of paints.

The gun comprises a body 1 having a grip 2 and including in its upper part a planar support surface on which is disposed an assembly for heating the air and the paint designated generally by the reference numeral 3.

The assembly 3 comprises a heating block 4 which, in the illustrated embodiment, is of cylindrical shape, a first envelope 5 having generally the shape of a bell and a second envelope 6 also having a bell shape disposed on top of the envelope 5, the block 4, the envelope 5 and the envelope 6 each comprising a centre aperture through which extends a stud 7 which is rigid with the body 1 and on the end portion of which is screwed a wing nut 8 which maintains the heating assembly secured to the body 1 of the gun.

Figure 2:
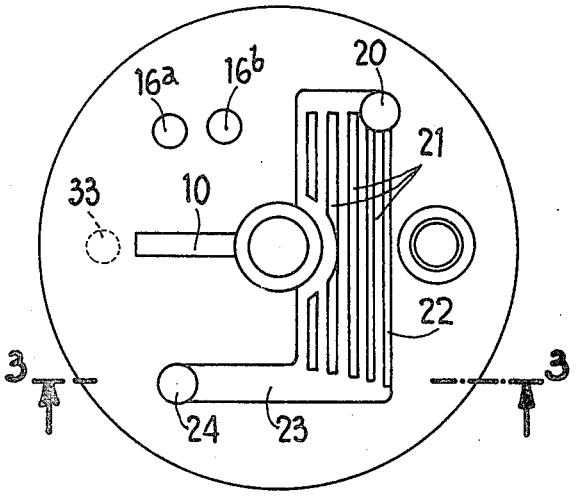
FIG. 2 is a top plan view of the heating block of the gun shown in FIG. 1.
Figure 5:
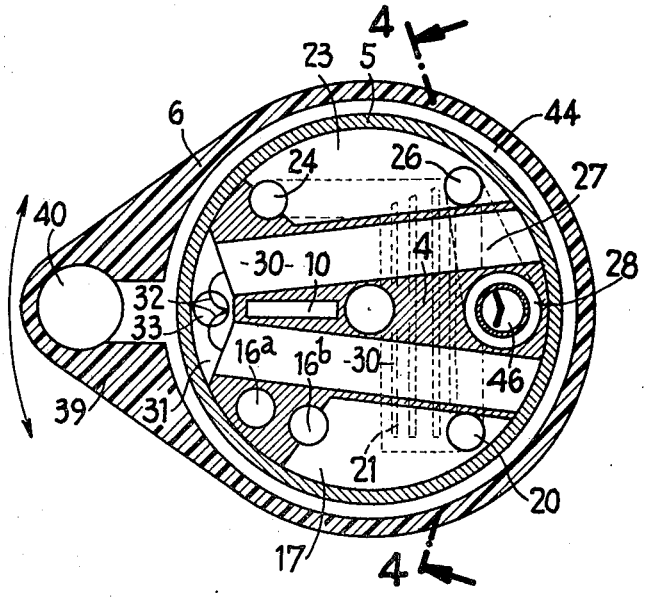
FIG. 5 is a sectional view from above of the heating block taken on line 5—5 of FIG. 4.

A trigger 9 is pivotally mounted at its upper end in a slot 10 (FIGS. 2 and 5) formed axially in the heating block 4 and actuates the needle valve member 11 in the known manner.

An air supply conduit 12 formed in the grip of the gun conveys the compressed air to a chamber 13 from which it escapes by way of a conduit 14 formed in the body of the gun through an opening provided in an insulating sealing plate 15 interposed between the heating block 4 and the body 1 of the gun, into a conduit 16 divided into two branches 16*a*, 16*b* which are joined together in a chamber 17. Disposed in the branch 16*a* is a device 18 for controlling and regulating the temperature which will be described in more detail hereinafter.

Figure 3:
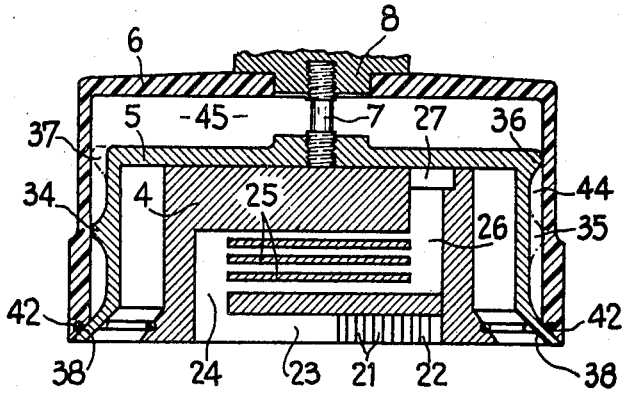
FIG. 3 is a sectional view of the heating block taken on line 3—3 of FIG. 2.
Figure 4:
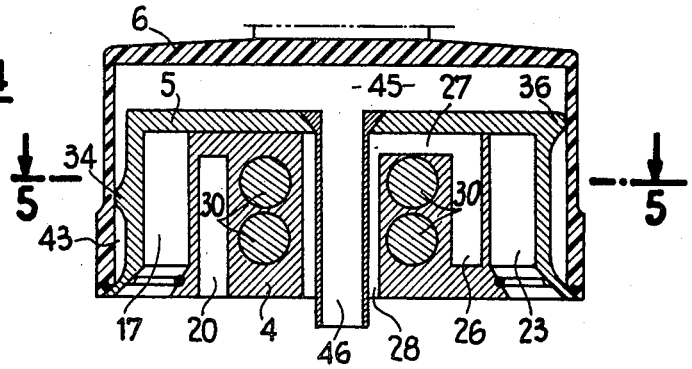
FIG. 4 is a sectional view taken on line 4—4 of FIG. 5.

As can be seen in FIG. 1, the chamber 17 has a plurality of fins 19 which are machined in the material of the block 4 whose end opposed to the pipe 16*b* defines a vertical chamber 20 whose lower end communicates with a plurality of parallel conduits 21 defined by a series of transverse fins 22 machined in the block 4 and opening onto a horizontal passage 23 which opens into a chamber 24 (FIG. 3) in which extend fins 25 machined in the block 4 and whose opposite end defines a vertical conduit 26 whose upper end opens into a transverse groove 27 machined in the upper surface of the block 4 so as to connect the upper end of the conduit 26 to the upper end of a passageway 28 which extends downwardly through the block 4 to the lower surface of the latter (FIG. 4).

The branches 16*a*, 16*b* of the conduit 14, the chamber 17, the vertical conduit 20, the conduits 21, the passage 23, the chamber 24, the vertical conduit 26, the groove 27 and the passageway 28 together define a first sinuous path through which travels the air for spraying the jets of paint.

Figure 6:
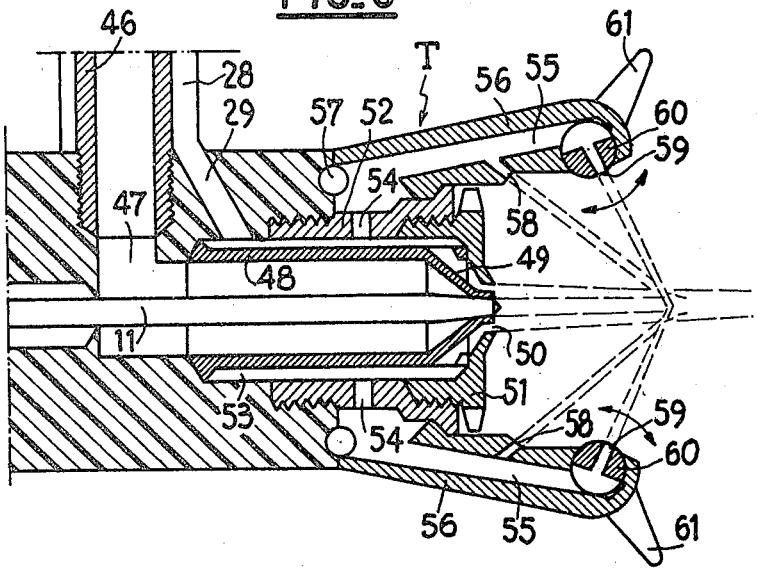
FIG. 6 is a partial sectional view of the spraying head of the gun.

The lower end of the passageway 28 coincides with an aperture provided in the sealing plate 15 which communicates with a passage 29 (FIG. 6) formed in the end of the body 1 of the gun and supplying the air to the spraying head T which will be described hereinafter.

When the air travels through the sinuous path defined hereinbefore, it is in contact with a very large surface of the block 4 which is heated by means of electric resistances 30, namely four resistances in the illustrated embodiment which are inserted in cavities formed in the mass of said block 4 in openings provided in a milled part 31 of this block and through which extend the supply conductors 32 of the resistances which are connected to an outer supply cable (not shown) by way of a throughway aperture 33 provided in the insulating plate 15.

It will be understood that the various passages, conduits, and the fins together define a considerable heating surface.

The heating block 4 is disposed within the first housing 5 constituted by an element of metal which has the general shape of a cup which is, in the presently described embodiment, cylindrical and forms a bell covering the block 4 whose upper surface is in contact with the bottom surface of the element 5. The peripheral edge of the envelope 5 is slightly outwardly flared for a purpose which will be described hereinafter.

The envelope 5 has a first peripheral bead 34 which radially outwardly projects midway of its height and extends through almost the whole of the periphery to the exception of a ground-away part 35, and a second peripheral bead 36 which projects radially outwardly at the end of the envelope 5 opposed to its peripheral edge 38. The bead 36 extends also roughly throughout the periphery of the envelope to the exception of a ground-away part 37 which is diametrally opposed to the part 35.

The first envelope 5 is covered with a second envelope constituted by an element which is advantageously made from a moulded plastics material in the form of a cup whose inside diameter is equal to the overall diameter (measured at the apex of the beads 34 and 35 and the peripheral edge 38) of the first envelope 5.

The second envelope has a lateral boss 39 which is moulded thereon in the vicinity of its edge and has a passage 40 whose ends are screwthreaded for receiving a plug 41 for closing the selected one of the ends of the passage 40.

The edge of the second envelope 6 covers the flared edge 38 of the first envelope 5 with which it coincides, an anti-friction sealing O-ring 42 being provided for sealing the junction between the envelopes.

These two envelopes thus define therebetween, as seen in FIGS. 1, 3 and 4, a second sinuous path constituted by the passage 40 which communicates with the interior of the envelope 6, a first annular space 43 defined between the peripheral edge 38 and the bead 34 of the first envelope 5 by the second envelope, this first space communicating by way of the ground-away part 35 with a second peripheral space 44 defined between the beads 34 and 36 by the second envelope 6, this second space 44 communicating by way of the ground-away part 37 with a chamber 45 defined between the inner ends of the first and second envelopes 5 and 6 and which has an outlet conduit 46 which extends concentrically in the passageway 28 at a certain distance from the inner walls of the latter.

The passage 40 of the boss 39 may be connected to a paint supply pot and it will be understood that the paint may travel through the path defined hereinbefore in contact with the whole of the outer surface of the first envelope 5 which is heated directly by contact with the heating block 4.

Preferably, the volumes of the first sinuous path for the air and the second sinuous path for the paint are calculated so as to represent a volume slightly greater than the volume delivered within a given period of time by the paint gun.

The outlet conduit 46 is connected in a sealed manner to a chamber 47 formed in the body 1 of the gun in the vicinity of its head T, as will be described.

Extending coaxially through the chamber 47 is the needle valve member 11 actuated by the trigger 9. A nozzle 48 having a conical end 49 is fixed in the known manner coaxially in the chamber 47, the opening of the end 49 being closed by the end of the needle valve member. The nozzle 48 is concentric with an opening 50 defined by a first sleeve 51 which is screwed in a second sleeve 52 fixed in the end 1 of the body. The air supply passage 29 communicating with the passageway 28 opens into an annular chamber 53 defined by the end of the body 1 and the second sleeve 52 with the nozzle 48. This chamber 53 communicates by way of radial apertures 54 with two passages 55 provided in the two branches 56 of the head T in a conventional manner.

The head T, which is advantageously made from an injection-moulded plastics material, is rotatively mounted in a sealed manner between the end of the second nozzle 52 and the end of the body 1 of the gun in the known manner with interposition of a sealing O-ring 57 of anti-friction matrial between the body 1 and the head T.

According to the invention, the conduit 55 of each branch 56 has a first air outlet orifice 58 which is obliquely oriented so that the orifices 58 direct first jets of air which meet on the extension of the axis of the needle valve member 11, the orifice 58 being located in an intermediate part of each branch 56 between the outer end of the latter and the nozzle 52, and a second air outlet orifice 59 provided in the vicinity of the end of each branch and angularly orientable.

The orifices 59 are each formed in a cylindrical body 60 fitted in a cavity of complementary shape provided at the end of each branch 56 by moulding and comprising at one end a radial projection 61, each cylindrical body 60 being rotatively mounted in its cavity and being capable of being oriented by means of its projection 61.

It will be understood that, with this arrangement, it is possible to turn the head T about an axis coinciding with the axis of the needle valve member 11 and also to regulate the angular position of the jets of air issuing from each of the oririces 59 so as to modulate the jet of paint sprayed by the air issuing from the annular orifice 50 around the end of the nozzle 48 and from the apertures 58.

As shown in FIG. 1, the assembly comprising the heating block 4 and the two envelopes 5, 6 is maintained on the body of the gun by means of the nut 8, the first envelope 5 having in its inner end a centre tapped aperture for screwing on a first screwthreaded portion of the stud 7, the nut 8 being screwed on the end portion of the stud so as to ensure a seal with the end of the second envelope 6. It will be understood that, if the nut 8 is unscrewed, the second envelope 6 may be turned about the axis constituted by the stud 7 so as to bring the boss 39 in a diametrally opposed position in which it is possible to connect the lower end of the passage 4 to a pot fixed directly on the passage. In the position shown in FIG. 1, with the lower end of the passage 40 closed by the plug 41, the device is arranged to be gravity-fed by means of a pot fixed directly on the upper end of the passage 40.

The rear end of the needle 11, which is elastically biased toward the position for closing the nozzle 48 by means of a spring disposed in the chamber 13, in the known manner, comprises a valve member 62 adapted to cooperate with a seat 63 at the end of the chamber 13 so as to control the passage of the air in the conduit 14. A recess (not shown) is advantageously provided in the valve member 62 to permit the passage of a small stream of air when the heating resistances carry current and the gun is not actuated. Owing to this small stream of air, the heating block 4 has a cooling stream continuously passing therethrough.

The temperature regulating device 18 shown diagrammatically in FIG. 1 will now be described in more detail with reference to FIG. 7.

This device may comprise in the conventional manner a sensor disposed in the branch **16*a* which in operation receives a part of the stream of air supply, the other part of which flows in the branch 16*b***. This sensor is thus cooled by the arrival of air and cuts off the supply to the resistances and re-establishes it as soon as the temperature drops below a pre-determined value. This arrangement is conventional.

Figure 7:
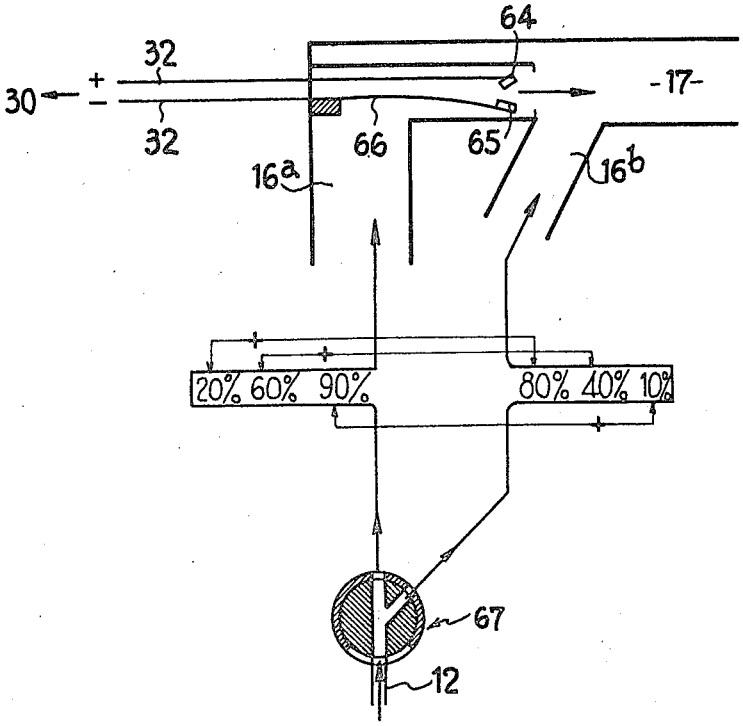
FIG. 7 is a diagrammatic view of the temperature regulating device of the gun according to the invention.

Advantageously, the gun according to the invention comprises a temperature regulating device disposed in the branch **16*a* which comprises, as shown in FIG. 7, a fixed contact 64, a moving contact 65 carried by a curved metal strip 16 which is fixed in position by its opposite end. The fixed contact 64 and the strip 66 are connected to the conductors 32 and to the resistances 30** by a source of current (not shown).

The strip 66 is disposed in the branch **16*a* of the conduit 14 and is exposed to a part of the air supplied to the gun, the remaining part being deviated into the branch 16*b*. The strip 66 is such that, when cold, the contacts 64 and 65 are closed, so that the resistances 30 are supplied with current. These resistances heat the block 4 and the heat is communicated to the strip 66 which moves away from the contact 64 and opens the contacts 64 and 65 and interrupts the supply of current to the resistances. As the air supply continues to impinge on the strip 66**, it cools the latter sufficiently to once more close the contacts and this cycle is repeated.

Advantageously, a valve having a plurality of ways, generally designated by the reference numeral 67 and adapted to convey into the branches **16*a* and 16*b* complementary different amounts of air-for example 20% of the air supply in the branch 16*a* and 80% in the branch 16*b* or 60% in the branch 16*a* and 40% in the branch 16*b* etc.—is provided. In this way it is possible to modify the period of time required for cooling the strip 66** and acting on the time during which the heating resistances are supplied with current.

If desired, a suitable control device may be inserted in the circuits of the resistances 30 so as to achieve a still finer regulation of the temperature of the gun.

The gun described hereinbefore simultaneously heats the amounts of air and paint which are merely slightly greater than the amounts delivered during a given period of time by the nozzles of the head of the gun. The volumes to be heated are consequently small and this economizes energy. Further, as the heating resistances are completely insulated from the paint circuit, the gun may be employed with present-day paints having a high degree of dilution the mist of which is explosive with no risk of deflagration.

Furthermore, the gun described hereinbefore is compact, easy to use and may be employed with a gravity-feed cup or with aspiration in a cup carried below the apparatus, so that the latter is extremely handy to use. Note that the head of the gun is manually adjustable without use of any tool and that the body of the gun of plastics material, which is a poor conductor of heat, enables a relatively high heating temperature to be employed for the paint with no inconvenience to the operator.

I claim:

1. A gun for the hot application of paints, comprising a substantially horizontally extending body having a downwardly extending grip, an assembly comprising a cylindrical heating block having a vertical axis and including electric resistances mounted on the body, a first envelope defining with the block a sinuous path for the heating of air, and a second envelope defining a path for paint, means for automatically controlling the temperature of the spraying air, said second envelope being in the shape of a bell pivotally mounted on top of and around the first envelope and defining with means provided on an outer surface of the first envelope communicating first and second annular paths for the paint superimposed around said first envelope and communicating with a chamber defined between end walls of the first envelope and second envelope, said chamber having an outlet conduit which extends through said heating block, a vertical hot air outlet passageway which coaxially surrounds said outlet conduit, said conduit and said passageway separately opening outside said block into said body, said body being of insulating material and carrying a rotary spraying head having lateral branches, each of said branches comprising two air jets at least one of which two jets is adjustable, said block, first envelope and second envelope being in coaxial relation to one another on said vertical axis in said assembly, means for securing said assembly to a top part of said body, said second envelope comprising a lateral boss having a passage which communicates with said first path and second path for the paint, said boss being connectible selectively to a source of paint supplied by gravity located above the body and to a source of paint supplied by aspiration located below said body, and means for allowing said second envelope to be adjusted in position about said vertical axis relative to said first envelope and for securing said second envelope in the adjusted position relative to said first envelope, whereby said source of paint can be placed in a convenient position relative to said body, said vertical axis being so located relative to the grip that said passage in said boss can be placed in close proximity to a second vertical axis in vertical alignment with said grip.

2. A gun for the application of paints, comprising a body, an assembly comprising a cylindrical heating block having a vertical axis and including electric resistances mounted on the body, a first envelope defining with the block a sinuous path for the heating of air, and a second envelope defining a path for paint, means for automatically controlling the temperature of the spraying air, said second envelope being in the shape of a bell pivotally mounted on top of an around the first envelope and defining with means provided on an outer surface of the first envelope communicating first and second annular paths for the paint superimposed around said first envelope and communicating with a chamber defined between end walls of the first envelope and second envelope, said chamber having an outlet conduit which extends through said heating block a vertical hot air outlet passageway which coaxially surrounds said outlet conduit, said conduit and said passageway separately opening outside said block into said body, said body being of insulating material and carrying a rotary spraying head having lateral branches, each of said branches comprising two air jets at least one of which jets is adjustable, said means provided on the outer surface of the first envelope comprising beads which project from said outer surface and define with said second envelope the path for the paint from a point located close to a base of said block to said chamber provided at an end of said block opposed to said base, and conduit means connecting said outlet conduit to the spraying head.

3. A gun according to claim 1, characterised in that said assembly comprising the heating block (4), the first envelope (5) and the second envelope (6) is detachably fixed to the body (1) by a centre stud (7) and a tightening fixing means (8).

4. A gun according to claim 3, characterised in that said second envelope (6) is mounted to be pivotable about the stud (7) with its peripheral edge in sealing relation to that of the first envelope (5) when said fixing means (8) is untightened.

5. A gun according to claim 1, comprising means defining an air inlet conduit communicating with said sinuous path for heating the air and valve means controlling the supply of air to said air inlet conduit, said temperature regulating means comprising an electrical switch in an electric supply circuit for the resistances, which switch is disposed in a part of said inlet conduit, said valve means including a constantly open small by-pass passageway to supply air to said part of said inlet conduit containing said switch even when said valve is in a closing position thereof.

6. A gun according to claim 5, characterised in that it comprises a differential valve (67) having a plurality of ways adapted to direct selectively an adjustable part of the flow of the air supply through said inlet conduit **(16*a*), directly to the temperature regulating means and the rest of the air to a second conduit (16*b*)** which by-passes said regulating means.

7. A gun according to claim 1, characterised in that said rotary spraying head (T) comprises at the end of each of its lateral branches (56) extending on each side of the jet of paint projected by the head (T), an air jet (60) having an orifice (59) which is rotatively mounted in the known manner and a second air jet at an intermediate point of its length constituted by an orifice (58) which is oriented in such manner as to project a jet of air which encounters the jet of paint and makes a fixed angle with the lattter.

* * * * *